United States Patent [19]

Yoo

[11] Patent Number: 4,907,634

[45] Date of Patent: Mar. 13, 1990

[54] WALLET-ORGANIZER

[76] Inventor: Eddie B. Yoo, 35566 Mound Rd., Sterling Heights, Mich. 48310

[21] Appl. No.: 188,519

[22] Filed: Apr. 29, 1988

[51] Int. Cl.[4] ..... A45C 1/06

[52] U.S. Cl. ..... 150/135; 150/138; 150/143; 150/145; 150/147

[58] Field of Search ..... 150/131, 132, 135, 138, 150/139, 145, 147, 149, 52 B, 143; D3/56

[56] References Cited

U.S. PATENT DOCUMENTS

| | | | |
|---|---|---|---|
| 932,205 | 8/1909 | Wentz | 150/132 |
| 1,310,621 | 7/1919 | Holland | 150/149 |
| 1,821,379 | 9/1931 | Epstein | 150/132 |
| 2,219,807 | 10/1940 | Buxton | 150/147 |
| 2,520,176 | 8/1950 | Stanley | 150/145 X |
| 2,651,346 | 9/1953 | Nash | 150/143 |
| 3,454,993 | 7/1969 | Jacobson | 190/149 X |
| 3,856,063 | 12/1974 | Dengel | 150/147 X |
| 4,342,350 | 8/1982 | Resnick | 150/138 |

FOREIGN PATENT DOCUMENTS

| | | | |
|---|---|---|---|
| 919781 | 3/1947 | France | 150/138 |
| 2464038 | 4/1981 | France | 150/135 |
| 2535954 | 5/1984 | France | 150/138 |

OTHER PUBLICATIONS

"Passport Case" (Item D), St. Thomas, p. 27, A Leather Accessories catalog from St. Thomas of Gloversville, N.Y.

*Primary Examiner*—Sue A. Weaver

*Attorney, Agent, or Firm*—Dykema Gossett

[57] ABSTRACT

An organizer for money, credit cards, valuable papers and the like comprising a plurality of sheets in face-to-face relationship stitched together along respective sides to define a plurality of storage sections. The organizer is expandable and has a closure member with a plurality of positions to thus accommodate the expanded organizer. A removable holder may be alternatively secured in the organizer or removed from the organizer, folded back upon itself and secured to itself to provide a removable storage section for travellers checks.

7 Claims, 2 Drawing Sheets

WALLET-ORGANIZER

BACKGROUND OF THE INVENTION

This invention relates generally to wallet-organizers, i.e., an article for holding money, credit cards, and miscellaneous documents. More specifically, the present invention relates to an improved wallet-organizer which may be secured, closed, in a plurality of positions depending upon the amount of items placed in the organizer, and in addition has removable portion which may be utilized to hold travellers checks or the like, the removable portion functioning alternatively as part of the organizer and separately from the organizer.

Prior to the present invention there were, of course, numerous varieties of organizers or wallet-organizers adapted to hold money, checks, credit cards and valuable documents. Each of these organizers provides a plurality of storage sections, pouches or pockets to hold and maintain, separate from each other, money, checks etc.

One of the problems with wallet-organizers is that although it is desirable to be able to fasten the wallet-organizer in a closed position, as more and more items were placed in the organizer it became increasingly difficult, if not impossible, to secure the organizer in a closed position. This is because filling the organizer with money, credit cards and the like, resulted in misalignment of the fastening mechanism.

When people travel, it is common to take "travellers checks" which are issued in numerous denominations, in various currencies and by various institutions. These travellers checks typically are provided in a form of a "wallet" or holder from which they may be individually removed as needed. While such a holder for travellers checks is convenient when the travellers checks are to be used, such a holder may be inconvenient when numerous items such as cash, credit cards, passports and other documents are to be carried simultaneously whether in a purse or in clothing pockets.

SUMMARY OF THE INVENTION

The present invention overcomes some of these problems by providing an improved wallet organizer having numerous beneficial features. For example, and not by way of limitation, the wallet-organizer of the present invention is expandable and may be secured, or fastened, in a plurality of positions depending upon the bulk or volume of the items placed within the wallet-organizer thus providing protection against accidental loss of the contents of the wallet-organizer.

The wallet-organizer of the present invention includes a removable holder for travellers checks or the like. In a first use the travellers checks may be secured in the holder which, in turn, is secured within the wallet-organizer. In a second use the holder may be separated from the wallet-organizer and the travellers checks may be secured within the holder.

DESCRIPTION OF THE DRAWINGS

These along with numerous other objects and advantages of the present invention will become apparent upon reading the detailed description of the invention taken in conjunction with the drawings. In the drawings, where like reference numerals identify corresponding components.

DETAILED DESCRIPTION OF THE INVENTION

Figure 1:
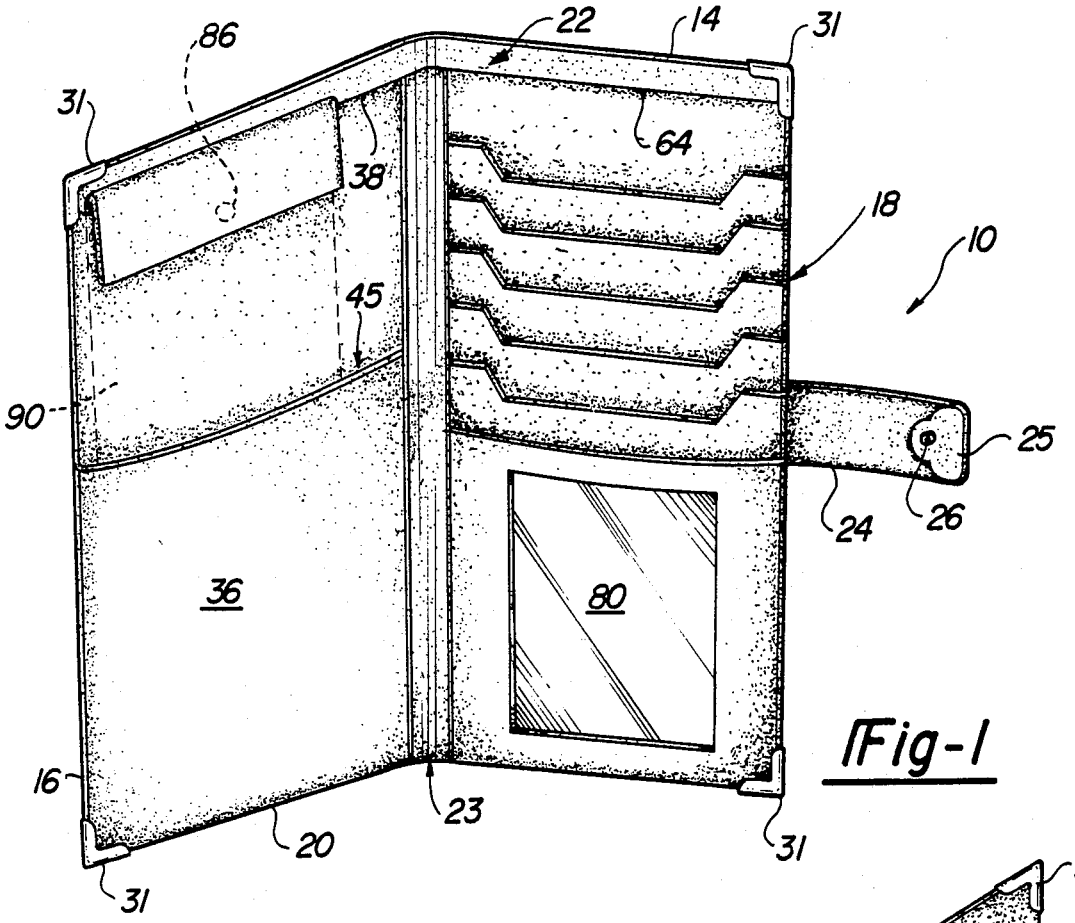
FIG. 1 is a perspective illustration of the present invention, in an open position, illustrating the interior of the wallet organizer.

With reference to the five figures of the drawings, a wallet-organizer 10 is illustrated. The wallet-organizer is made of a plurality of sheets of material where exposed surfaces may be leather or the like, while interior surfaces may be made of a synthetic fabric. By way of example and illustration, the wallet-organizer of the present invention includes first sheet means comprising two generally rectangular sheets 12, 14, of essentially the same size, positioned in face-to-face relationship and secured together at their opposite sides 16 and 18 and at the bottom 20 to thus define a first storage section 22 therebetween. The first storage section is essentially the same size as the sheets 12, 14. Rectangular sheets 12 and 14 may be thought of as the exterior wall or sheet 14 and interior wall or sheet 12 of the wallet-organizer. The wallet-organizer may be folded in half, longitudinally, along the fold 23 as illustrated generally in FIGS. 1 and 2.

Figure 5:
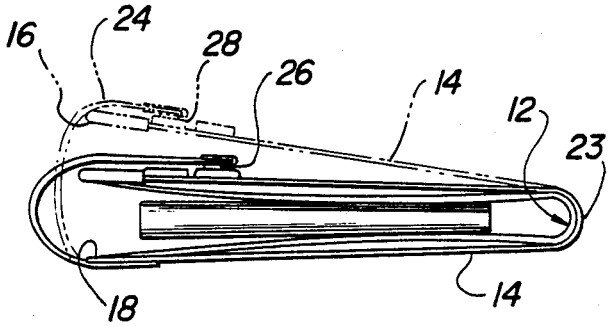
FIG. 5 is an end view of the wallet-organizer of the present invention showing the mechanism for fastening the wallet-organizer closed in a plurality of positions with a first position shown in solid lines and a second position shown in phantom lines.

Closure means is provided to secure the folded wallet-organizer in a plurality of closed positions. The closure means includes a strap or tab 24 extending from the exterior sheet 14 and terminating in a decorative guard 25 from which extends a stud 26. The stud functions as part of a stud and socket closure. The strap or tab 24 extends from the exterior sheet 14, generally half-way between the top and bottom and outwardly from the side 18. On the opposite side 16 of the exterior sheet 14, at the same height above the bottom 20 as the strap 24, and spaced inwardly from the side 16, are a plurality of spaced apart sockets 28, 30. These sockets cooperate, individually, with the stud 26 on the strap to function as a closure. Thus, the stud 26 will snap into either socket 28 or socket 30. As illustrated in greater detail in FIG. 5, the organizer may be secured in a closed position with the fastener 26 in the closure 30, or alternatively in an expanded but still closed position shown in phantom lines in FIG. 5 with the stud 26 in the socket 28. Decorative guards 31 may be provided at the four corners of the sheet means to provide protection and to assist in holding the interior and exterior sheets 12, 14 together.

Figure 2:
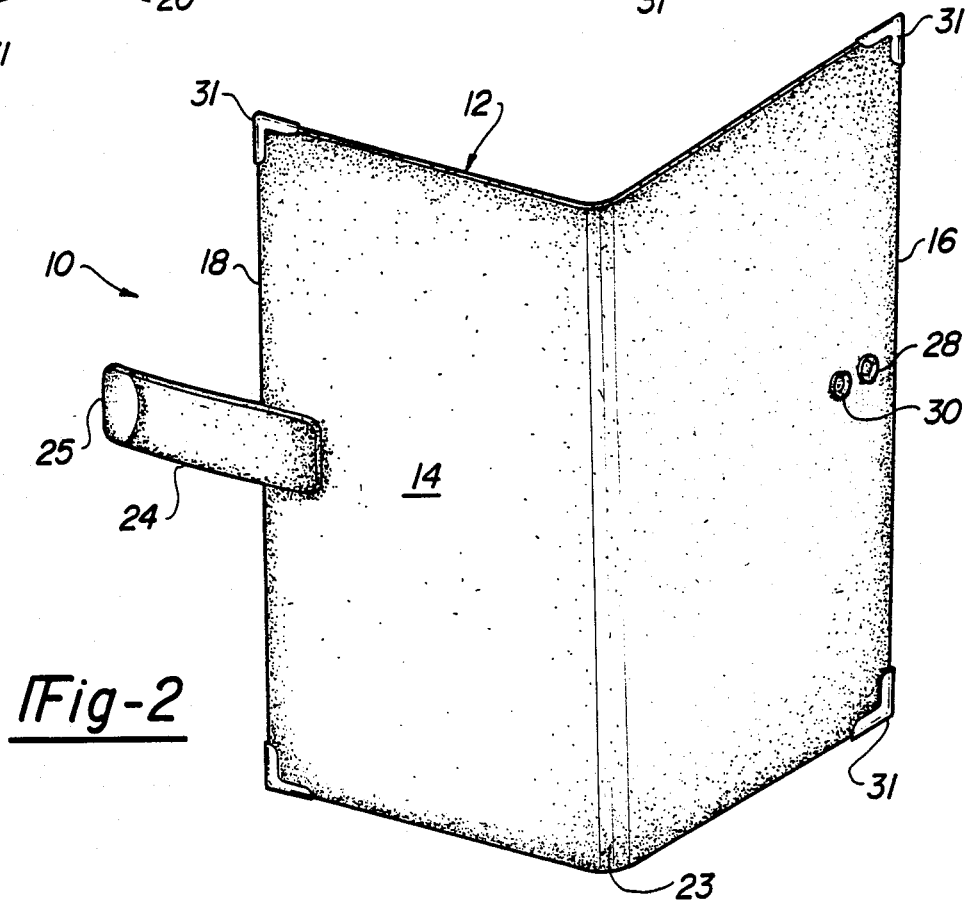
FIG. 2 is a perspective view of the wallet-organizer of the present invention, in an open position, illustrating the exterior of the wallet organizer.
Figure 3:
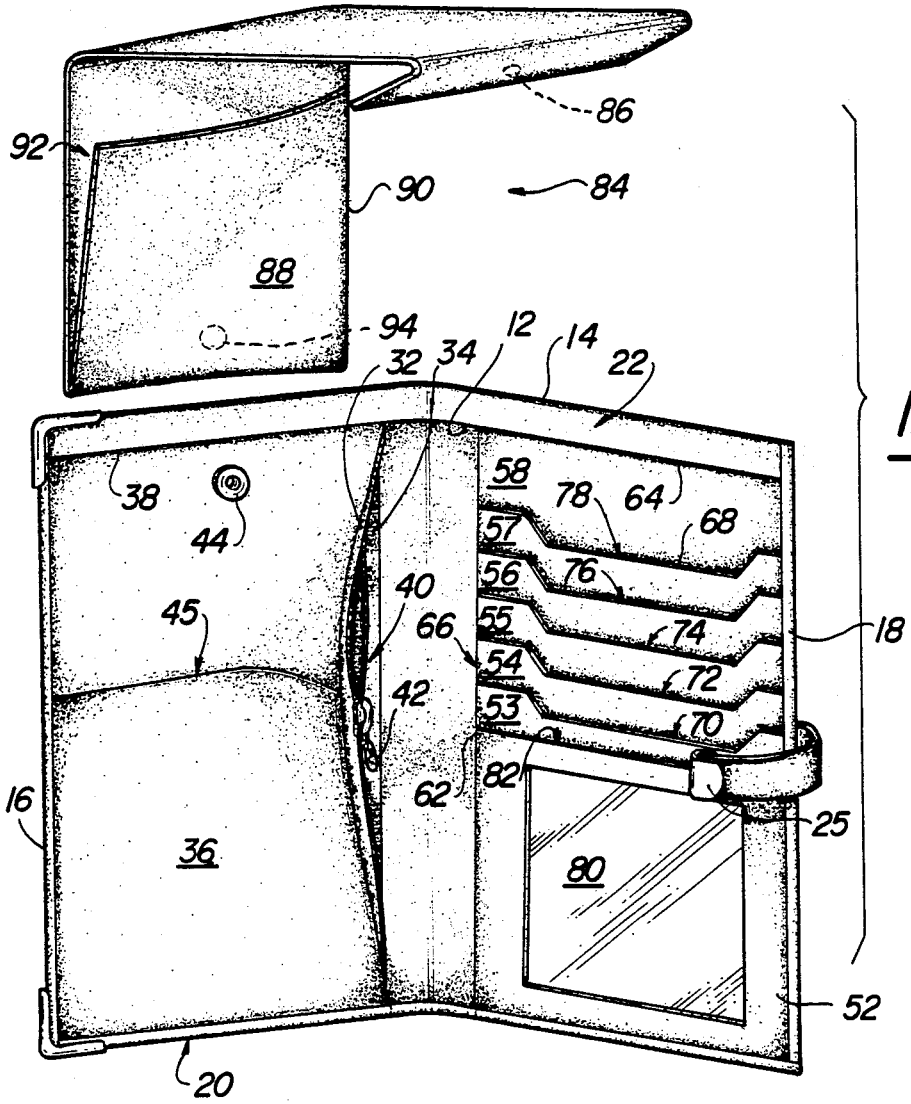
FIG. 3 is an exploded illustration of the wallet-organizer of the present invention showing the removal of the holder for travellers checks.
Figure 4:
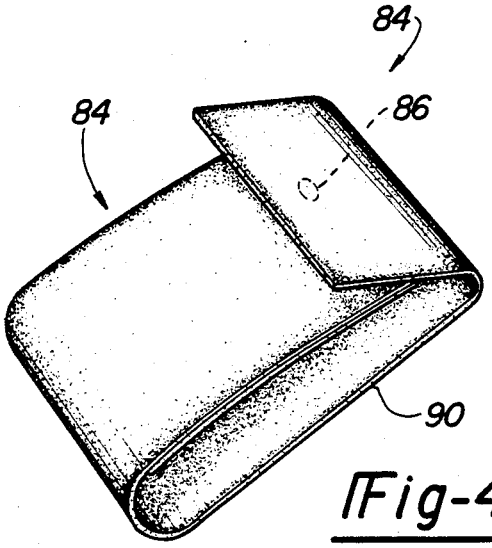
FIG. 4 is an illustration of the holder for travellers check separate from the wallet-organizer.

The organizer of the present invention also includes a second sheet means positioned generally on the left side of the wallet-organizer as viewed from the interior in FIGS. 1 and 3. The second sheet means includes two sheets 32, 34 which need not be of leather because they are not fully exposed to view, the sheets 32 and 34 each being generally the height of the sheet 12, but just slightly less than one-half the width of the sheets 12, 14. A third sheet 36, having generally the same width as the sheets 32, 34 but approximately one-half the height of the sheets, 32, 34, also forms a part of the second sheet means. The second sheet means is secured together and to the first sheet means in the following manner. Stitching is provided at the top 38 of the sheets 32 and 34 to secure these two sheets to the sheet 12. The left side as viewed from the interior, which left side has been previously identified as side 16, includes stitching not only of sheets 12 and 14 together but also of sheets 32, 34 and 36. Thus, portions of the stitching extends through five sheets. The right side 40 of the second sheet means is provided with a closure 42 such as a zipper securing the right side of sheet 32 to the corresponding side of sheet 34. A socket 44 is provided at the top of the second sheet means as will be explained in greater detail.

Sheets 32 and 34 are positioned in face-to-face relationship and in face-to-face relationship with a portion of sheet 12, and a storage section is thus defined by sheet 12 and sheet 34; another storage section is thus defined at the region between sheets 32 and 34, which is closed by the closure or zipper 42, and another storage section is provided by the sheet 36 in face-to-face relationship with a portion of sheet 32, with this storage section being open at the top and closed at the sides 16 and 40 as well as closed along the bottom edge 20. This storage section 45 may desirably be shaped and configured to receive a passport.

Considering next the right side of the organizer as illustrated in FIGS. 1 and 3, third sheet means are provided to define additional storage sections. The third sheet means includes vertically staggered, partially overlapping individual sheets 52, 53, 54, 55, 56, 57 and 58, each in face-to-face relationship with sheet 12. These individual sheets are all secured on their left side 62 to each other and on the right side 18 to each other and to the sheet 12. In addition, sheet 58 is secured to sheet 12 along the top 64 and along the bottom 20. Each of the sheets 53-57 are provided with a chamferred top 68. The third sheet means defines a storage section 66 extending the length of the organizer, on the right side thereof, being defined as the space between the sheet 12 and the sheets 52-58, plus a plurality of storage sections or pockets 70, 72, 74, 76 and 78, each of a size and shape suitable to receive credit cards and the like, and each being defined by two adjacent sheets positioned on top of sheet 12. The vertically lower most sheet 52 which is provided with a clear plastic sheet a window 80 is in face-to-face relationship with sheet 12 thus defining a storage area 82 therebetween.

The organizer of the present invention also includes a removable fourth sheet means or holder 84 formed as a generally elongated rectangle and having a snap fastener stud 86 at one end thereof. The opposite end of the sheet is doubled back or folded to form a portion approximately one-third the length of the sheet means, the folded section 88 being stitched as at 90 to one edge of the sheet 84. The fourth sheet means thus provides a partial pocket or partial storage section 92 between the sheet 84 and the folded section 88.

On the back of the sheet 84, opposite from the folded section 88, a socket 94, is provided.

The fourth sheet means is intended as a removable holder for travellers checks or the like. As illustrated in FIGS. 1 and 3 the fourth sheet means is intended to be inserted in the first storage section 22 with the stud 86 on the fourth sheet means being insertable into the socket 44 at the top of the second sheet means. The fourth sheet means may be removed from the organizer and folded in half, along an axis perpendicular to the longitudinal axis of the fourth sheet means such that the stud 86 will engage the socket 94. In this fashion, travellers checks or the like placed within the fourth sheet means may be conveniently carried separate and apart from the organizer 10. As may be appreciated, the quality of the sheet means, leather, or the like, may be varied depending upon the objectives, and market conditions.

The present invention is not restricted to any particular fabric but rather to the concepts described. Many modifications may be made for without departing from the spirit and scope of the present invention. The present invention, therefore, should be limited only by the following claims.

What is claimed is:

1. A wallet-organizer for a passport and storage items including money, credit cards, and valuable papers comprising in combination:

first sheet means secured together for forming a first storage section having an opening for insertion, in generally a first direction, of storage items thereinto, the first sheet means being foldable generally in half about an axis extending generally in said first direction and including adjustable first closure means located remotely from said opening for holding said first sheet means in a folded posture;

second sheet means secured together and superposed and secured to generally one half of said first sheet means for forming a second storage section including at least two distinct storage portions, one of said two distinct storage portions having a second closure means, another of said two distinct storage portions being dimensioned to receive the passport when the passport is inserted therein in generally said first direction, said second sheet means including a first attaching means;

third sheet means secured together and superposed and secured to generally the other half of said first sheet means for forming a third storage section including a plurality of individual sheets aligned in partially overlapping sequence for forming a plurality of aligned pockets into which storage items are insertable generally in said first direction, said second and third storage means being generally superposed to one another and the passport being insertable into and removable from said second sheet means when said adjustable first closure means holds said first sheet in said folded posture; and fourth sheet means having a partial pocket for forming a fourth storage section, said fourth sheet means having a first and second end, said first end of said fourth sheet means having a second attaching means attachable to said first attaching means and said second end of said fourth sheet means having a third attaching means attachable to said second attaching means when said second end of said fourth sheet means is doubled back over said first end of said fourth sheet means, said fourth sheet means being removable secured to said wallet-organizer in said opening of said first sheet means when said first and second attaching means are attached, said fourth sheet means being removable from said opening and insertable back thereinto when said adjustable first closure means holds said first sheet means in said folded posture, so that said first, second and third sections remain enclosed within said wallet-organizer.

2. The organizer as defined in claim 1, wherein said first sheet means includes first and second sheets secured together in a face-to-face relationship for forming said first storage section therebetween.

3. The organizer as defined in claim 1, wherein said first sheet means includes first and second sheets positioned in face-to-face relationship and secured together along three sides, and wherein said fourth sheet means is inserted between the first and second sheets of said first sheet means.

4. The organizer as defined in claim 1, wherein said second storage section includes three distinct storage portions.

5. The organizer as defined in claim 1, wherein said second sheet means includes a plurality of sheets positioned and secured in face-to-face relationship.

6. The organizer as defined in claim 1, wherein said plurality of individual sheets collectively form one face of a storage section.

7. The organizer as defined in claim 1, wherein said second attaching means is a snap fastener stud and said first and third attaching means are snap fastener sockets.

* * * * *